United States Patent [19]

Bataille et al.

[11] 4,422,248

[45] Dec. 27, 1983

[54] SYSTEM FOR KEEPING THE FOOT AND THE LEG IN POSITION

[76] Inventors: Jean R. Bataille; Nicole J. J. Charollais Bataille, both of 20, rue du Commandant rené Mouchotte, Paris, France

[21] Appl. No.: 184,083

[22] Filed: Sep. 4, 1980

[30] Foreign Application Priority Data

Sep. 12, 1979 [FR] France ..... 79 22838
Aug. 19, 1980 [FR] France ..... 80 18134

[51] Int. Cl.[3] ..... A43B 5/04
[52] U.S. Cl. ..... 36/121
[58] Field of Search ..... 36/117, 118, 119, 120, 36/121, 89, 90

[56] References Cited

U.S. PATENT DOCUMENTS 3,538,627 11/1970 Labat-Camy ..... 36/120
3,854,743 12/1974 Hansen ..... 36/121

FOREIGN PATENT DOCUMENTS 1951072 6/1970 Fed. Rep. of Germany ..... 36/121
2633555 2/1978 Fed. Rep. of Germany ..... 36/121

*Primary Examiner*—Patrick D. Lawson
*Attorney, Agent, or Firm*—Wolf, Greenfield & Sacks

[57] ABSTRACT

A system for keeping the foot and the leg in position wherein there are two stirrups passing under a sole and respectively co-operating with an assembly of fore support and an assembly of back support co-operating with one another at each side of the ankle.

13 Claims, 4 Drawing Figures

FIG_1
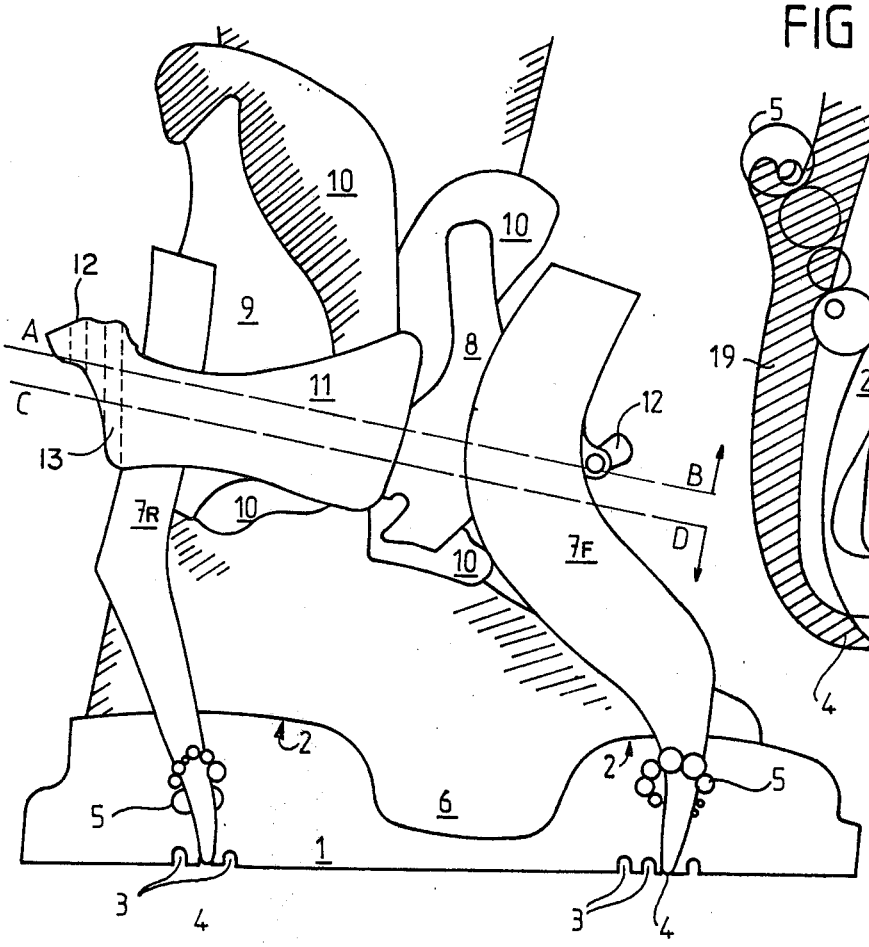
FIG_3
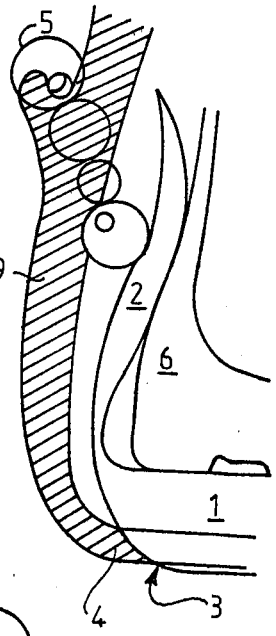
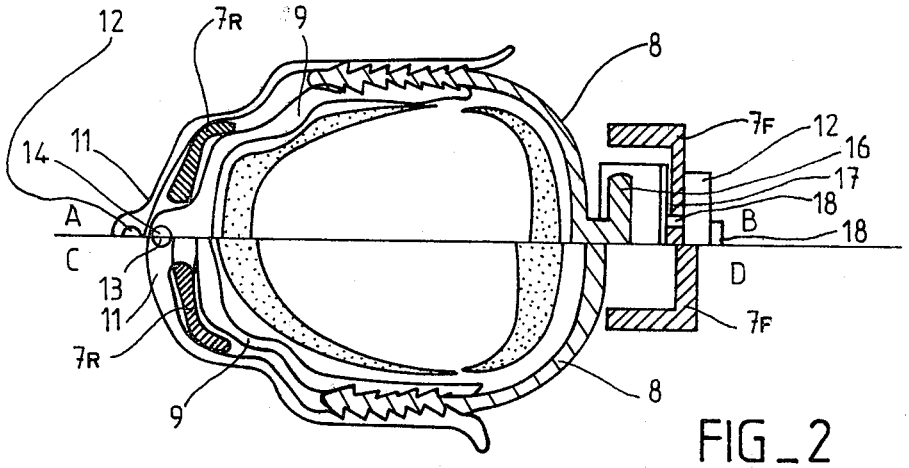
FIG_2

SYSTEM FOR KEEPING THE FOOT AND THE LEG IN POSITION

The present invention relates to a system for keeping the foot and the leg in position, which is necessary when going in for certain sports such as ski.

Several systems for keeping the foot in position when going in for ski are already known.

The present invention is aimed at putting the foot and the leg in position or easily releasing them, whatever the shoes used such as supple ones.

To this end, the present invention relates to a system for keeping the foot and the leg in position, wherein two stirrups pass under a sole by respectively co-operating with an assembly of fore support and an assembly of back support which co-operate with one another at each side of the ankle.

According to a further characteristic of the invention, the underneath part of the sole carries at least two grooves intended to receive the lower parts of the stirrups.

According to another characteristic of the invention, the side edges of the sole are raised so as to go up along the feet.

According to another characteristic of the invention, wedges with a variable thickness act between the internal faces of the stirrups and the raised side edges of the sole.

According to a further characteristic of the invention, the wedges with a variable thickness consist of a ring carrying bulges with different thickness, said ring being attached along each leg of the stirrups.

According to another characteristic of the invention, the support assemblies can be adjustable in height in relation to the stirrups.

According to another characteristic of the invention, one of the adjusting systems in height of the support assemblies in relation to the stirrups is made integral with the corresponding support assembly by means of a resilient piece.

According to a further characteristic of the invention, the resilient piece which makes the adjusting system in height integral with the corresponding support assembly is positioned before the leg.

According to another characteristic of the invention, the support assemblies consist of a semi-rigid element keeping in position at several points a flat-shaped supple device which distributes the pressure of said semi-rigid element onto the corresponding part of the shoe wherein the foot is.

According to another characteristic of the invention, one of the semi-rigid elements holds the other at each side of the ankle and co-operates with it by means of notches located on the external surface of the narrowest and on the internal surface of the largest of said semi-rigid elements.

According to another characteristic of the invention, the less large semi-rigid element is contained in a third semi-rigid element which holds the assembly and co-operates with the opposite semi-rigid element by means of notches respectively located at the internal surface of the largest semi-rigid element and at the external surface of the average semi-rigid element, the largest semi-rigid element carrying at its rear portion two holes alined along the great axle of the system, the internal hole being located at a certain interval under a hole with the same diameter which equips the narrowest element.

According to a further characteristic of the invention, the fore support assembly carries a horse shoe-shaped element provided with a peduncle resting onto the rubber resilient piece, said peduncle and resilient piece being housed in a box whose side external edges are notched and kept in said box by means of the lateral studs of said peduncle.

According to a further characteristic of the invention, the horse shoe-shaped element is provided at its sides with apertures facing each other, the first of said apertures leaving passage to the cable fixing the assembly constituted by the fore and back stirrups and the fore and back support assemblies, the second of said apertures receiving the axle of a locking piece.

According to another characteristic of the invention, the locking piece carries an axle supporting a ribbed handle, the ribs resting on a lateral resting surface of the horse shoe-shaped element.

Finally, according to another characteristic of the invention, the fore support element carries on its lateral surfaces a path of curve cam, the horse shoe-shaped element keeping in position the support element during the flexion movement of the leg and exerting a downward and rearward pressure when the system is locked so as to block the heel of the user.

The present invention will be better understood by means of the modes of embodiment diagrammatically shown by way of example in the attached drawings, wherein:

FIG. 1 is a side view of the assembly of the device at a reduced scale.

FIG. 2 is a cross-section view along AB of the upper part of FIG. 1, along CD of the lower part of FIG. 1.

FIG. 3 is a cross-section view of a detail of the sole and of one of the stirrups associated with the annular wedge carrying bulges.

Figure 4:
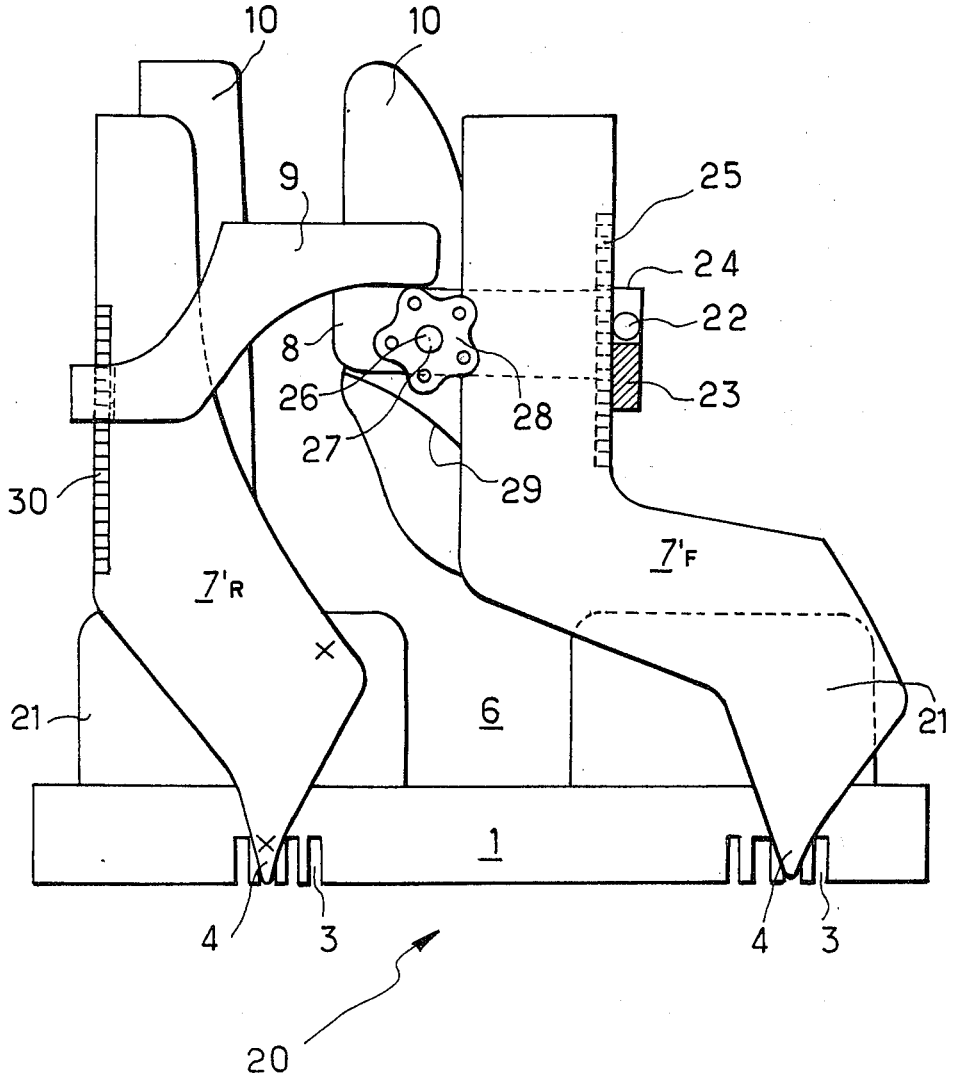
FIG. 4 is a side view of the system keeping the foot and the leg in position.

As shown in FIG. 1, the device consists of a sole 1 whose side edges 2 are raised. The lower part of the stirrups 4 is positioned in one of the transversal grooves 3. The annular wedges, bulging rings 5 set apart the raised edges 2 of the sole from the internal faces of the stirrups 7 exerting a pressure onto the foot in the supple shoe at the fore and back parts thereof. The upper part of the stirrups 7 makes it possible to adjust the height of the semi-rigid elements 8 and 9 which keep in position the flexible pockets containing a fluid (according design 10). The external semi-rigid element, the largest of the three ones, is shown at 11 and a portion of the device adjusting the height at 12 (locking eccentric according to design).

As shown in FIG. 2, the device comprises a semi-rigid element 8, the two lateral faces of which are notched, hold between an internal semi-rigid element 9 whose external faces of its lateral walls are notched and an external semi-rigid element 11 notched on the internal face of its lateral walls.

The upper part of the semi-rigid element 11 is pierced with a hole 12: cross-section AB, and with a hole 13 at its lower part: CD.

The upper part of the semi-rigid element 9 is pierced with a hole at 14.

The semi-rigid element 8 carries a peduncle 12, cross-section AB, embedded in a resilient piece 17, cross-section AB, integral with an element adjusting the height 18 locked by the locking eccentric 12 (according to the design) cross-section AB, on the upper part of the stirrup 17: front part of cross-section AB. The supple pockets containing a fluid 10 distribute the pressure, cross-sections AB and CD.

As shown in FIG. 3, Scale 1, the lower part of the stirrup 4 located in the groove 3 of the sole 1 keeps said stirrup in position while the wedge with a variable thickness immobilized about the lateral leg of the stirrup 19 keeps at a desired space the lateral edge of the sole 2 which rests against the shoe 6.

The system works as follows: after adjusting the height 12 and the width by means of wedges 5, the foot is introduced into the device open. When the device is closed, the semi-rigid element 8 is interlocked between the semi-rigid element 9 and the semi-rigid element 11. The introduction of the ski stick simultaneously into the alined holes 14 of the internal semi-rigid element 9 and 13 of the external semi-rigid element, located somewhat below the hole 14 and the alternative foreward-rearward, rearward-foreward motions of the level exerted by the stick cause through the notches of the external and average semi-rigid elements the average semi-rigid element to move forward towards the internal semi-rigid element. The pockets 10 distribute the pressure against the ankles and the instep till said pressure is convenient. The resilient assembly 16 and 17, associated with the clearance allowed by the wedges with fluid, provides a foreward-rearward suppleness.

The opening of the device is obtained by introducing the tip of the ski stick into the hole 12 of the external semi-rigid element and through a rearward push, causing the external semi-rigid element to swing, the latter thus turning about its rear lower angle escapes its notches and tends to drive the force intermediate semi-rigid element. Associated with a foreward pressure of the foot, this motion of the stick causes the device to open.

As shown in FIG. 4, the specific mode of embodiment of the system 20 comprises two fore and rear stirrups 7 passing under a sole 1 and co-operating with a fore support assembly 8, 10 and a rear support assembly 9, 10 co-operating with one another and at each side of the ankle.

In addition, the sole 1 carries high lateral edges 21 so as to ensure a better keeping of the foot of the user in position.

The fore support assembly 8, 10 carries an element 8 generally horse shoe-shaped provided with a peduncle 22 resting against a resilient piece of rubber 23.

The peduncle 22 and the resilient piece are embedded in a box 24 whose external lateral edges are notched. The peduncle 22 and the resilient piece 23 are kept in position in the box by means of lateral studs not shown in this Figure of the peduncle 22.

The box 24, laterally notched, co-operates with the notches 25 arranged on the internal face of an aperture of the fore stirrup 7. Said notches make it possible to adjust the height of the element 8 and of the piece 10.

The horse shoe-shaped element 8 is provided at its side apertures 26 facing one another (only one aperture is shown in this Figure). The first aperture 26 is provided for the passage of the cable fixing the assembly consisting of the fore and rear stirrups 7 and the fore support assemblies 8, 10 and the rear ones 9, 10. The second aperture 26 receives the axle 27 of a locking piece 28.

When the system is locked on the foot of the user, the various pieces constituting the fore and rear supports are tightened up against the leg of the user and made integral with one another by means of a cable whose free end is connected to the locking piece 28.

The user tightens and locks the system at will by making the locking piece 28 rotate about its axle 27 engaged in the aperture 26.

According to this specific mode of embodiment, the locking piece carries a ribbed handle, the ribs not shown in this Figure resting onto a lateral resting surface of the horse shoe-shaped element 8.

The fore support element 10 carries a path of curved cam 29. The horse shoe-shaped element 8 keeps in position the support element 10 by means of said path of cam during the flexion movements of the leg. In addition, the path of cam 29 exerts a downward and rearward push when the system 20 is locked for blocking the heel of the user.

The rear support piece 9 slides along the rear stirrup 7 and can be positioned at an adjustable height thanks to notches arranged on the internal surfaces of the piece 9 co-operating with the notches arranged on the external face of the stirrup 7.

What we claim is:

1. A system for maintaining the foot and the leg in position, comprising two independent stirrups of unitary construction, each stirrup passing under and within a transverse groove of a rigid sole, one stirrup toward the front and one at the back of the foot, the lateral borders of the sole being raised along the edges of the foot, said stirrups cooperating respectively with a fore support assembly and a rear support assembly located on either side of the ankle.

2. The system of claim 1, further comprising wedges located between the internal edges of the stirrups and the raised lateral borders of the sole, the thickness of said wedges being selectively variable.

3. The system of claim 2, wherein each of said wedges comprises a ring with bulges the thickness of which can be varied, each of said rings being attached to a leg of the stirrups.

4. A system for keeping the foot and the leg in position according to claim 1, wherein the height of the support assemblies can be adjusted in relation to the stirrups.

5. A system for keeping the foot and the leg in position according to claim 4, wherein one of the adjusting systems is made integral with the corresponding support assembly by means of a resilient piece.

6. A system for keeping the foot and the leg in position according to claim 5, wherein the resilient piece which makes the system for adjusting the height in relation to the stirrups integral with the corresponding support assembly is located before the foot.

7. A system for keeping the foot and the leg in position according to claim 6, wherein the support systems consist of a first semi-rigid element keeping in position at several points a flat-shaped supple device.

8. A system for keeping the foot and the leg in position according to claim 7, wherein one of the semi-rigid elements holds the other at each side of the ankle and co-operates with it by means of notches arranged on the external surface as regards the narrowest and on the internal surface as regards the wider one.

9. A system for keeping the foot and the leg in position according to claim 8, wherein the less wide semi-rigid element is contained in a third semi-rigid element which holds the assembly and co-operates with the opposite semi-rigid element by means of notches respectively located on the internal surface of the wider semi-rigid element and on the external surface of the average semi-rigid element, said wider semi-rigid element being carrying at its rear portion two holes alined about the great axle of the system, the internal hole being located somewhat below a hole with the same diameter, equipping the narrowest semi-rigid element.

10. A system for keeping the foot and the leg in position comprising two stirrups passing under a sole and respectively co-operating with a fore support assembly and a rear support assembly co-operating with one another at each side of the ankle, wherein the fore support assembly (8,10) carries a horse shoe-shaped element (8) provided with a peduncle (22) resting on the resilient piece of rubber (23), said peduncle (22) and resilient piece (23) being embedded in a box (24) whose external lateral edges are notched and kept in position in said box by means of the lateral studs of said peduncle (22).

11. A system for keeping the foot and the leg in position according to claim 10, wherein the horse shoe-shaped element (8) is provided at its edges with apertures (26) facing one another, the first of said apertures (26) being provided for the passage of a cable for the fixing of the assembly constituted by the fore and rear stirrups (7) and the fore support assemblies (8, 10) and rear ones (9, 10), the second of said apertures (26) receiving the ;axle (27) of a locking piece (28).

12. A system for keeping the foot and the leg in position according to claim 11, wherein the locking piece (28) carries an axle (27) supporting a ribbed handle, the ribs resting on a lateral resting surface of the horse shoe-shaped element (8).

13. A system for keeping the foot and the leg in position according to claim 10, wherein the fore support element (10) carries on its lateral faces a path of curved cam (29), the horse shoe-shaped element (8) keeping the support element (10) in position during the flexion movements of the leg and exerting a downward and rearward push when the system 20 is locked so as to block the heel of the user.

* * * * *